US007018486B2

(12) United States Patent
Bhatia

(10) Patent No.: US 7,018,486 B2
(45) **Date of Patent: *Mar. 28, 2006**

(54) CORROSION RESISTANT TRIVALENT CHROMIUM PHOSPHATED CHEMICAL CONVERSION COATINGS

(75) Inventor: Promila Bhatia, Farmington, CT (US)

(73) Assignee: United Technologies Corporation, Hartford, CT (US)

( * ) Notice: Subject to any disclaimer, the term of this patent is extended or adjusted under 35 U.S.C. 154(b) by 354 days.

This patent is subject to a terminal disclaimer.

(21) Appl. No.: 10/187,179

(22) Filed: Jun. 27, 2002

(65) Prior Publication Data

Related U.S. Application Data

(63) Continuation-in-part of application No. 10/146,435, filed on May 13, 2002, now Pat. No. 6,648,986.

(51) Int. Cl.
*C23C 22/00* (2006.01)

(52) U.S. Cl. ..... 148/267; 148/243; 106/14.11

(58) Field of Classification Search ..... 148/267, 148/243; 106/14.11; 428/469, 472
See application file for complete search history.

(56) References Cited

U.S. PATENT DOCUMENTS

| | | | | |
|---|---|---|---|---|
| 4,107,004 | A * | 8/1978 | Ward et al. | 205/286 |
| 4,171,231 | A | 10/1979 | Bishop et al. | |
| 5,304,257 | A | 4/1994 | Pearlstein et al. | |
| 5,374,347 | A | 12/1994 | Pearlstein et al. | |
| 6,631,622 | B1 | 10/2003 | Ghent et al. | |
| 6,648,986 | B1 * | 11/2003 | Tang et al. | 148/267 |
| 6,756,134 | B1 * | 6/2004 | Hodgens et al. | 428/658 |

FOREIGN PATENT DOCUMENTS

| | | |
|---|---|---|
| WO | WO 99/08806 | 2/1999 |
| WO | WO 01/92595 | 12/2001 |

* cited by examiner

*Primary Examiner*—Scott Kastler
(74) *Attorney, Agent, or Firm*—Bachman & LaPointe, P.C.

(57) ABSTRACT

An acidic aqueous solution containing a water soluble trivalent chromium compound is provided with a additive for improving corrosion resistance and reducing precipitation of trivalent chromium over time. A suitable additive is nitrilotris (methylene) triphosphonic acid (NTMP).

22 Claims, 4 Drawing Sheets

Scanning electron micrograph of trivalent chromium phosphated coating on Al 2024 at 5,000x magnification

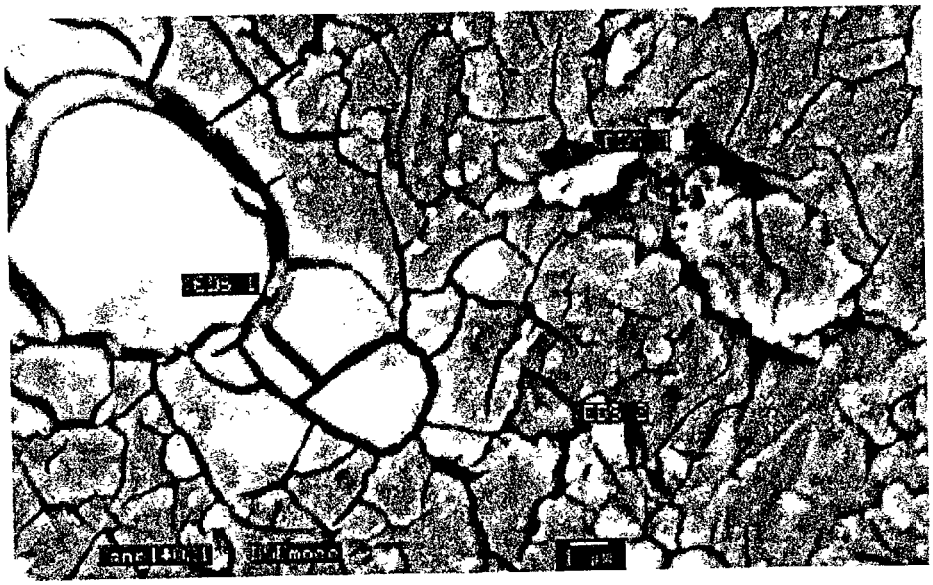
Fig.1: Scanning electron micrograph of trivalent chromium phosphated coating on Al 2024 at 5,000x magnification
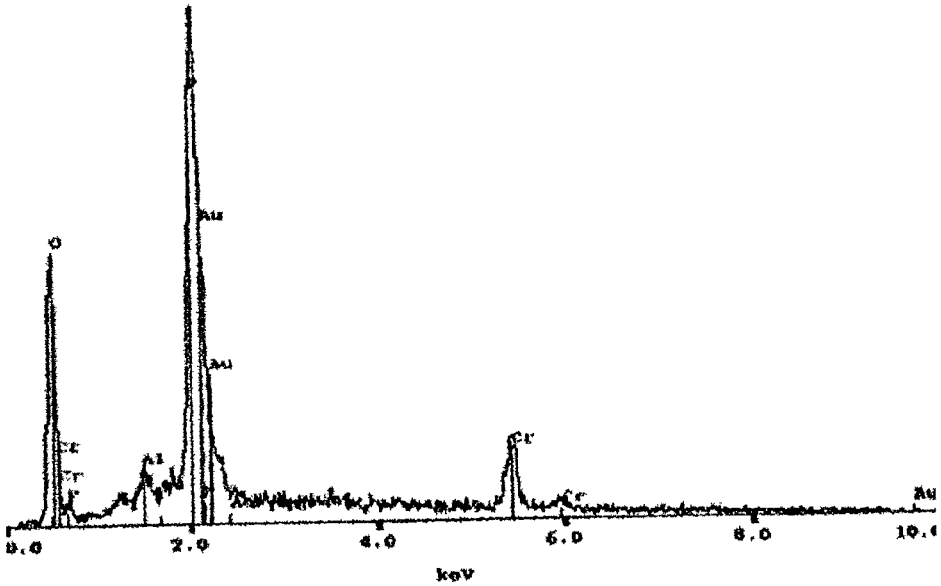
Fig. 2: EDS 1 spectrum for SEM of NTMP-15 coating on Al 2024

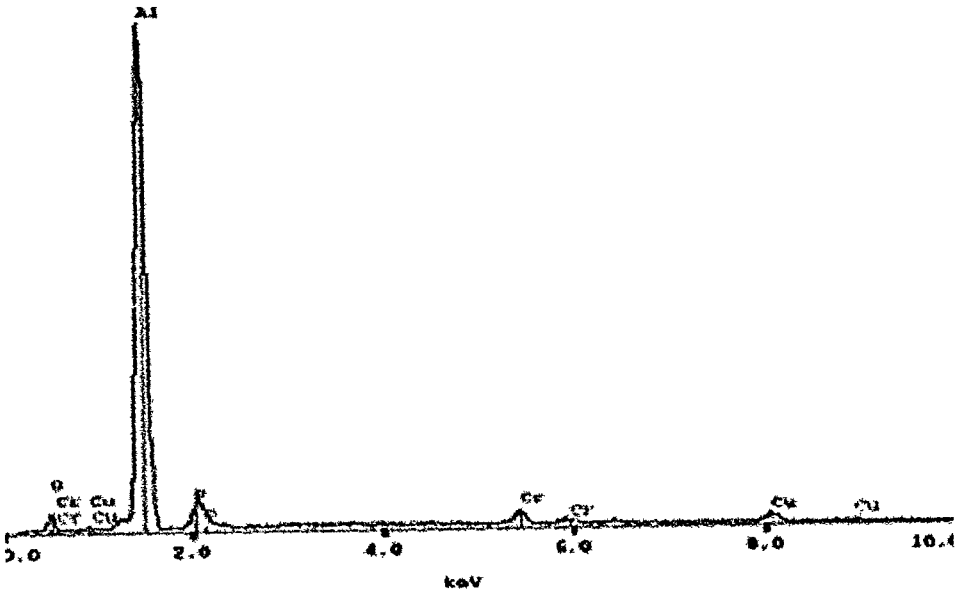
Fig. 3 : EDS 2 spectrum for SEM of NTMP-15 coating on Al 2024
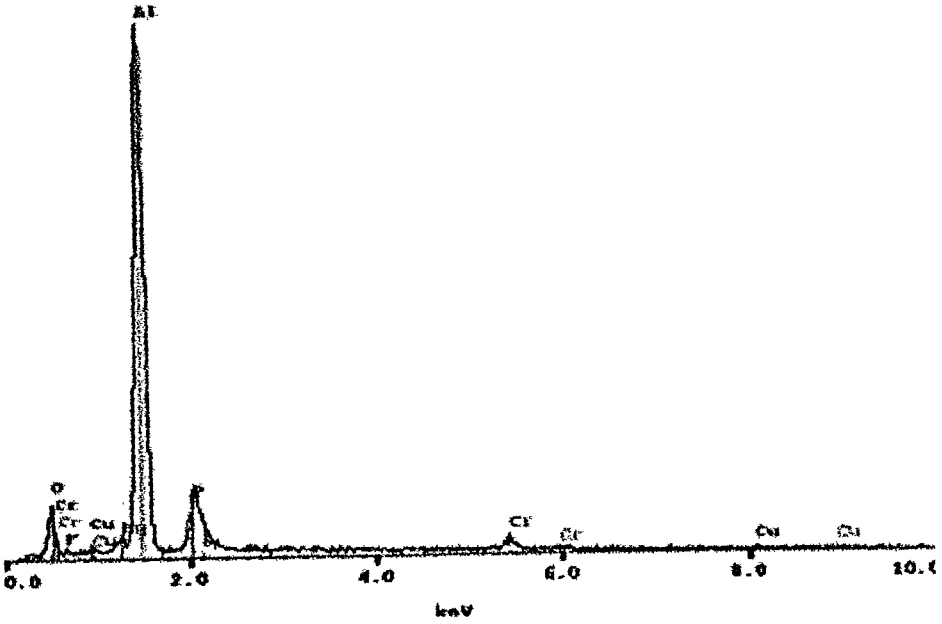
Fig. 4: EDS 3 spectrum for SEM of NTMP-15 coating on Al 2024

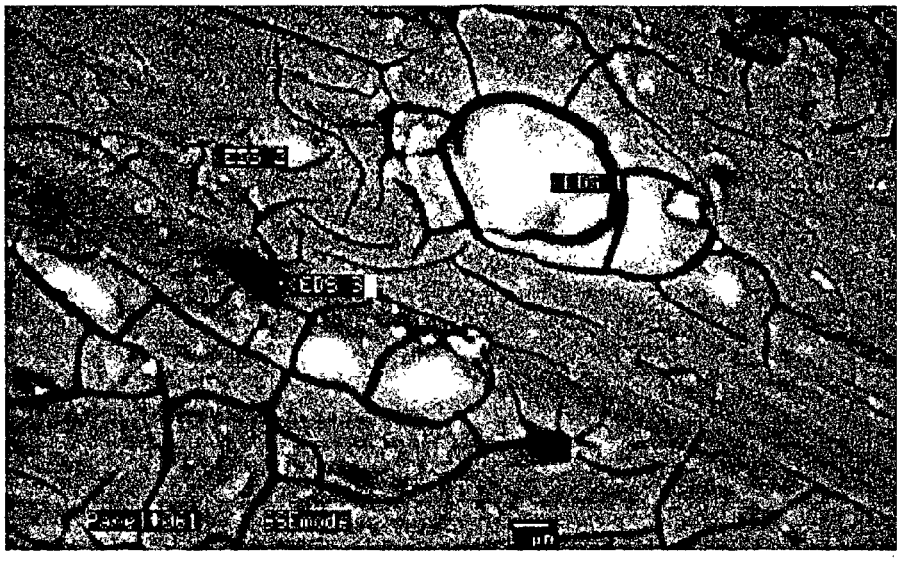
Fig. 5: Scanning electron micrograph of trivalent chromium phosphated coating on Al 6061 at 5,000x magnification
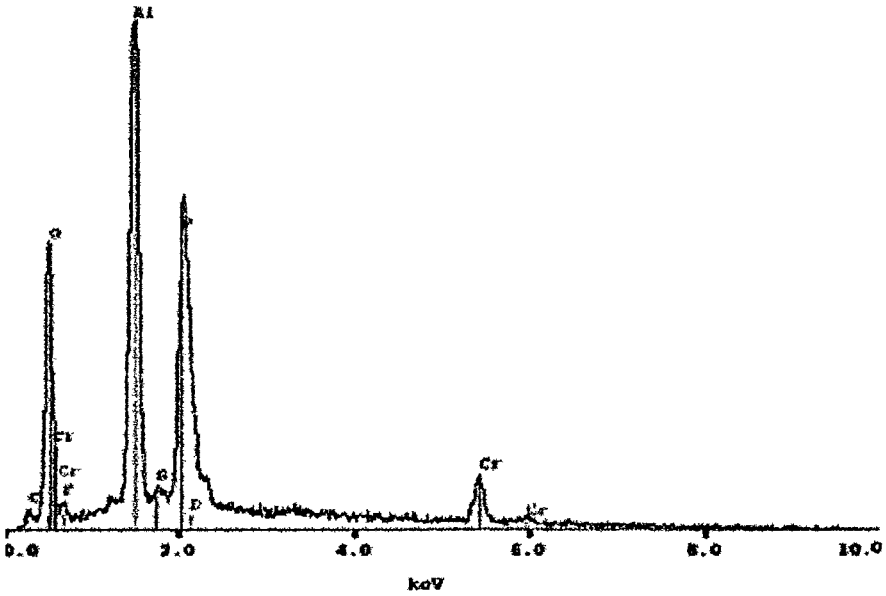
Fig. 6: EDS1 spectrum for SEM of NTMP-15 coating on Al 6061

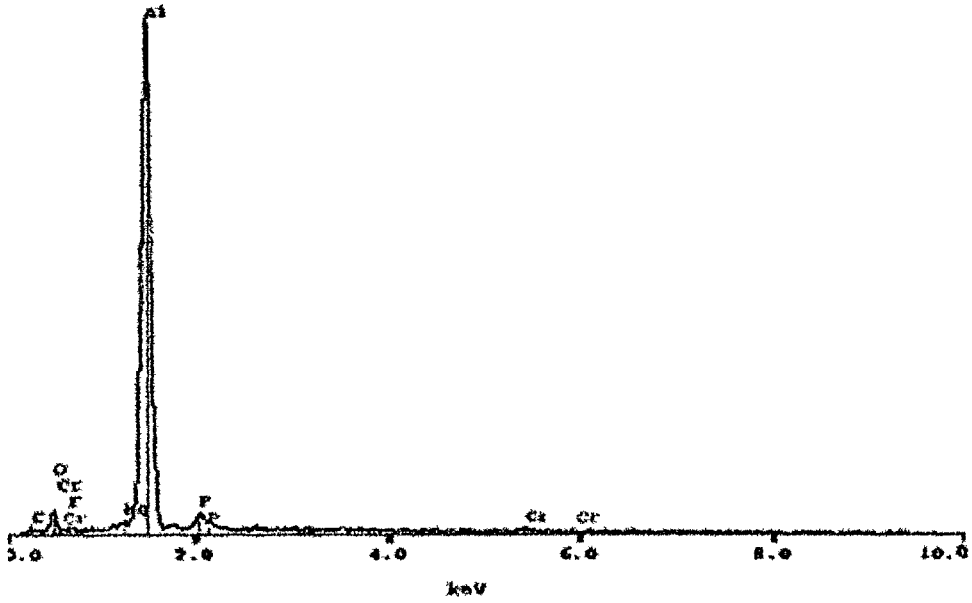
Fig. 7: EDS2 spectrum for SEM of NTMP-15 coating on Al 6061
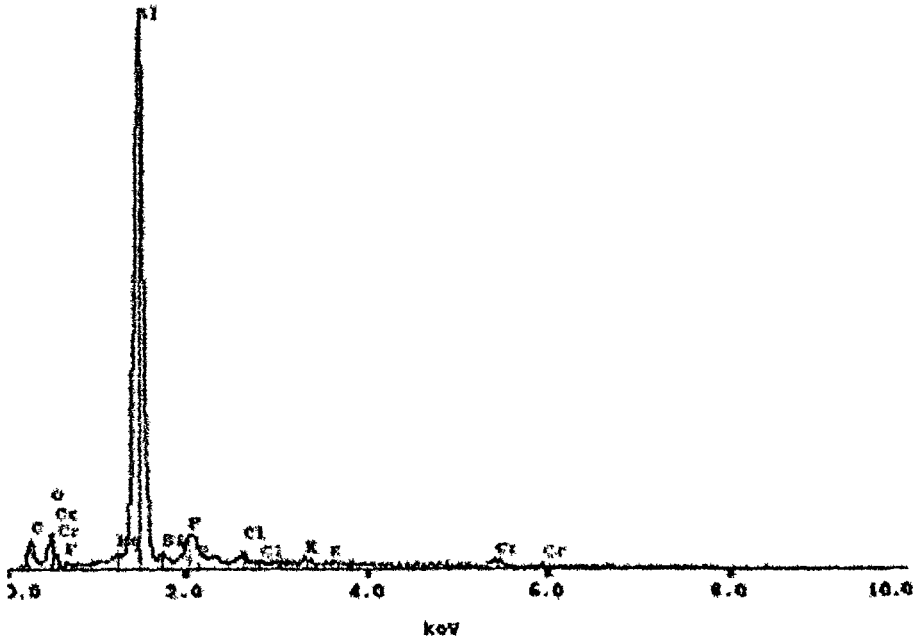
Fig. 8: EDS 3 spectrum for SEM of NTMP-15 coating on Al 6061

CORROSION RESISTANT TRIVALENT CHROMIUM PHOSPHATED CHEMICAL CONVERSION COATINGS

This application is a Continuation in part Application of U.S. application Ser. No. 10/146,435, filed on May 13, 2002, now U.S. Pat. No. 6,648,986.

BACKGROUND OF THE INVENTION

The present invention relates to a process for preparing a corrosion-resistant trivalent chromium phosphated chemical conversion coating for corrosion protection of structural alloys preferably aluminum and aircraft aluminum alloys, and other metals viz. iron/steel, zinc or galvanized steel etc. Other different applications of this coating also include as a seal-coating on anodized aluminum and a coating for improved durability of adhesively bonded aluminum structures.

Conversion coatings have been widely used in metal surface treatment for improved corrosion inhibition and improved adhesion of a subsequently applied paint layer. Conversion coatings are applied through chemical reactions between the metal and the bath solution which converts or modifies the metal surface into a thin film with required functional properties. Conversion coatings are particularly useful in surface treatment of metals such as a steel, zinc, aluminum and magnesium. In the past, chromate conversion coatings have proven to be the most successful conversion coatings for aluminum and magnesium. However, chromate conversion coatings used in the past generally contained highly toxic hexavalent chromium. The use of hexavalent chromium results in potential hazardous working conditions for process operators and very high costs for waste disposal.

In order to overcome the problems associated with hexavalent chromium containing conversion coatings, there has been an effort to employ trivalent chromium conversion coatings which are far more acceptable from an environmental standpoint. U.S. Pat. Nos. 4,171,231, 5,304,257 and 5,374,347 disclose trivalent chromium solutions for use in forming conversion coatings on metals. The corrosion protection provided by trivalent chromium coatings developed or described in these patents has been basically due to conversion of trivalent chromium to hexavelant chromium either by adding oxidizing agent in the coating bath solution or by post-treatment of the developed conversion coating by an oxidizing agent or by adding corrosion inhibitive species into the coating bath solution. In other words, one drawback of these trivalent chromium processes is that the corrosion protection is not as effective as hexavelent chromium process and whatever corrosion protection is provided is basically due to oxidation of trivalent chromium to hexavalent chromium either in the coating or coating bath solution. However, in the present process described in this invention, the improved corrosion protection is provided due to the adsorption of phosphonate groups of long chain functionalized organic amino-phosphonic acid compounds to aluminum oxide surface to form Al—O—P covalent bond and subsequent formation of network of hydrophobic layer over all active corrosion sites. A further drawback of these trivalent chromium processes and acidic aqueous solutions is the formation of chromium containing precipitate in the processing bath solution over time. The precipitation results in material loss in the solution and affects coating quality when the concentrations of key components drop below desired and required levels.

Accordingly, it is the principal object of the present invention to provide a trivalent chromium chemical conversion coating with similar corrosion resistance properties as the hexavalent chrome conversion coating and an effective stable coating bath solution, since these organic amino-phosphonic acids are known for their capability to chelate and form complexes with trivalent metal ions viz. $Cr^{+3}$, $Al^{+3}$ etc.

SUMMARY OF THE INVENTION

In accordance with the present invention the foregoing object is readily obtained.

In accordance with the present invention, an acidic aqueous solution containing a water soluble trivalent chromium compound is provided with an additive which is effective to increase corrosion protection and reduce precipitation of trivalent chromium over time. The additive comprises a chelating agent or a multidentate ligands e.g. comprising of phosphonic acid groups alone or in combination with acetic acid groups as ligands. The preferred additives for corrosion inhibition include the derivatives of the amino-phosphonic acids, e.g. the salts and esters like nitrilotris (methylene) triphosphonic (NTMP), hydroxy-, amino-alkyl phosphonic acids, ethyl imido (methylene) phosphonic acids, diethyl aminomethyl phosphonic acid etc., may be one or the other or a combination provided the derivative is substantially soluble in water.

BRIEF DESCRIPTION OF THE DRAWINGS

For the features of the present invention will be made clear from the following detailed description.

FIG. 1 is a scanning electron micrograph of trivalent chromium phosphated coating on Al 2024 at 5,000× magnification.

FIG. 2 is an EDS 1 spectrum for SEM of NTMP-15 coating on Al 2024;

FIG. 3 is an EDS 2 spectrum for SEM of NTMP-15 coating on Al 2024;

FIG. 4 is an EDS 3 spectrum for SEM of NTMP-15 coating on Al 2024;

FIG. 5 is a scanning electron micrograph of trivalent chromium phosphated coating on Al 6061 at 5,000× magnification;

FIG. 6 is an EDS 1 spectrum for SEM of NTMP-15 coating on Al 6061;

FIG. 7 is an EDS 2 spectrum for SEM of NTMP-15 coating on Al 6061; and

FIG. 8 is an EDS 3 spectrum for SEM of NTMP-15 coating on Al 6061.

DETAILED DESCRIPTION

The present invention relates to a process for preparing a corrosion-resistant trivalent chromium coating on a metal, preferably aluminum and aircraft aluminum alloys, and an improved acidic aqueous solution for use in the process.

The process for preparing a corrosion-resistant trivalent chromium coating on aluminum and aluminum alloy substrates comprises treating the substrates with an acidic aqueous solution, which is free of hexavalent chromium, comprising a water soluble trivalent chromium compound, a water soluble fluoride compound, and a corrosion improving additive which may also reduce precipitation of trivalent chromium. In accordance with the present invention, the additive comprises a chelating agent or a bi- or multidentate ligand. Generally, the additive is present in an amount of between 5 ppm (parts per million) to 100 ppm with respect to the total coating solution, preferably between 15 ppm to 30 ppm with respect to the total coating solution. The preferred additives for corrosion inhibition include the derivatives of the amino-phosphonic acids, e.g. the salts and esters like nitrilotris (methylene) triphosphonic (NTMP), hydroxy-, amino-alkyl phosphonic acids, ethyl imido (methylene) phosphonic acids, diethyl aminomethyl phosphonic acid etc., may be one or the other or a combination provided the derivative is substantially soluble in water. A particularly suitable additive for use as a corrosion inhibitive and solution stability additive is nitrilotris (methylene) triphosphonic acid (NTMP).

The diluted acidic aqueous solution comprises a water soluble trivalent chromium compound, a water soluble fluoride compound and an amino-phosphonic acid compound. The trivalent chromium compound is present in the solution in an amount of between 0.2 g/liter to 10.0 g/liter (preferably between 0.5 g/liter to 8.0 g/liter), the fluoride compound is present in an amount of between 0.2 g/liter to 20.0 g/liter (preferably 0.5 g/liter to 18.0 g/liter). The diluted trivalent chromium coating solution prepared in such a way has a pH between 2.5 to 4.0.

It has been found that by using the coating solution containing trivalent Cr in the amounts between 100 ppm to 300 ppm, fluoride in the amount between 200 ppm to 400 ppm and corrosion inhibitive amino-phosphonic acid compound in the amounts between 10 ppm to 30 ppm, excellent corrosion protection is obtained and precipitation of trivalent chromium is reduced over time when compared to coating solution without amino-phosphonic acid, as evidenced by the following example.

EXAMPLE

The following three main stock solutions were prepared: Part A solution: 8.0 g/L of Cr (III) salt in DI water. Part B solution: 18.0 g/L of fluoride containing salt in DI water. NTMP solution: 1000 ppm of Nitrilotris (methylene) triphosphonic acid, i.e. NTMP in DI water.

These solutions were prepared according to the following procedure given below:

Part A, i.e., Chromium (III) sulfate stock solution was prepared by dissolving 8.0 gm of trivalent chromium sulfate compound, purchased from Fluka (Milwaukee, Wis.), in 1 liter of deionized (DI) water. The solution was allowed to equilibrate before using it. Part B, i.e., Potassium flouro zirconate stock solution was prepared by dissolving 18.0 gm of this compound, purchased from Aldrich, (Milwaukee, Wis.) in 1 liter of DI water. The solution was allowed to get fully dissolved and stabilized. NTMP stock solution was prepared by dissolving 0.1 ml of 50 wt. % solution in water of NTMP, purchased from Sigma-Aldrich (St. Louis, Mo.) in 100 ml. of DI water. Different diluted coating bath solutions were prepared according to the compositions listed in Table I. One coating bath solution was prepared without NTMP to use it as a control coating for evaluating the effect of NTMP on corrosion performance. The pH of all bath solutions were in the range of 3.5–4.0.

TABLE I

Compositions of coating bath solutions

| Solution ID | Part A (mL) | Part B (mL) | DI water (mL) | NTMP (mL) |
|---|---|---|---|---|
| Control, without NTMP | 100 | 100 | 1800 | — |
| NTMP-5 | 100 | 100 | 1800 | 10 |
| NTMP-10 | 100 | 100 | 1800 | 20 |
| NTMP-15 | 100 | 100 | 1800 | 30 |
| NTMP-20 | 100 | 100 | 1800 | 40 |
| NTMP-25 | 100 | 100 | 1800 | 50 |
| NTMP-30 | 100 | 100 | 1800 | 60 |

All the solutions were prepared at the time of processing panels. Both Al 2024-T3 and Al 6061-T6 alloys of 3"×3" were coated in duplicate. The coatings were developed per the process described below:

1) All the test coupons were mechanically abraded on both sides using scotch brite and then cleaned by lightly rubbing with Kimwipes® under running tap water. The coupons were finally rinsed with DI water and dried with paper towels before immersing in bath solution for coating.

2) The test coupons were immersed in coating bath solutions for 10 minutes at room temperature.

3) The coated test coupons were later rinsed with DI water and air dried for at least 24 hours.

The blue-pink-violet color chemical conversion coatings having admixed oxides of chromium and phosphorous developed on the surface of Al 2024 and Al 6061 alloys. These coatings were evaluated for coating weight and corrosion performance. NTMP-15 coating was also examined by SEM/EDAX for morphological characterization.

The coating weight of all the developed coatings was found between 0.15 mg/sq. inch to 0.5 mg/sq. inch.

The corrosion resistance properties were evaluated by exposing the panels to salt fog spray test per ASTM B 117. The results are summarized in the following Table II.

TABLE II

Salt Fog Spray Test Results

| Coating ID | No. of Hrs. | Observations | |
|---|---|---|---|
| | | Al 2024 | Al 6061 |
| Control, without NTMP | 240 | Corrosion spots, 15–20% of total area | Corrosion spots, 10–15% of total area |
| NTMP-5 | 400 | No corrosion spots, stains at few places | No corrosion |
| NTMP-10 | 400 | No corrosion spots, stains at few places | No corrosion |
| NTMP-15 | 400 | No corrosion, stains at few places | No corrosion |
| NTMP-20 | 400 | No corrosion | No corrosion |
| NTMP-25 | 336 | Random corrosion pits at few to some places concentrated around edges, black staining type of corrosion | No corrosion except 2 pits found around the edges |
| NTMP-30 | 336 | Random corrosion pits found at few places | No corrosion |

TABLE II-continued

| Salt Fog Spray Test Results | | | |
|---|---|---|---|
| | | Observations | |
| Coating ID | No. of Hrs. | Al 2024 | Al 6061 |
| | | concentrated around the edges, black staining type of corrosion | |

Coating morphology: NTMP-15 trivalent chromium coating developed on Al 2024 and Al 6061 was examined using SEM/EDAX. Scanning electron micrograph (SEM) for coating on Al 2024 is shown in FIG. 1 and EDS spectra for the same coating on Al 2024 are shown in FIGS. 2–4. Similarly SEM micrograph for NTMP-15 coating developed on Al 6061 is representated in FIG. 5 and EDS spectra in FIGS. 6–8. Both, the micrographs and the EDAX spectra reveal the presence of phosphorous along with chromium in the conversion coating. It is believed that the phosphonic groups of amino-phosphonic acid get adsorbed on to the surface of alumium oxide and form Al—O—P chemical bonds.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An acidic aqueous conversion coating solution which is free of hexavalent chromium comprises a water soluble trivalent chromium compound, a water soluble fluoride compound, and an addictive comprising at least one organic amino-phosphonic acid compound for improved corrosion resistance properties.

2. An acidic aqueous solution according to claim 1 wherein the additive is nitrilotris (methylene) triphosphonic acid (NTMP).

3. An acidic aqueous solution according to claim 1 wherein the additive is present in an amount of between 5 ppm (parts per million) to 100 ppm with respect to the total acidic aqueous solution.

4. An acidic aqueous solution according to claim 2 wherein the additive is present in an amount of between 5 ppm to 100 ppm with respect to the total acidic aqueous solution.

5. An acidic aqueous solution according to claim 1 wherein the additive is present in an amount of between 5 ppm to 30 ppm with respect to the total acidic aqueous solution.

6. An acidic aqueous solution according to claim 2 wherein the additive is present in an amount of between 5 ppm to 30 ppm with respect to the total acidic aqueous solution.

7. An acidic aqueous solution according to claim 3 wherein the trivalent chromium compound is present in the solution in an amount of between 0.2 g/liter to 8.0 g/liter and the fluoride compound is present in an amount of between 0.2 g/liter to 18.0 g/liter, wherein the pH of the solution is between 3.5 to 4.0.

8. An acidic aqueous solution according to claim 4 wherein the trivalent chromium compound is present in the solution in an amount of between 0.5 g/liter to 8.0 g/liter and the fluoride compound is present in an amount of between 0.5 g/liter to 18.0 g/liter, wherein the pH of the solution is between 3.5 to 4.0.

9. An acidic aqueous solution according to claim 5 wherein the trivalent chromium compound is present in the solution in an amount of between 0.2 g/liter to 10.0 g/liter and the fluoride compound is present in an amount of between 0.2 g/liter to 20.0 g/liter, wherein the pH of the solution is between 2.5 to 4.0.

10. An acidic aqueous solution according to claim 6 wherein the trivalent chromium compound is present in the solution in an amount of between 0.5 g/liter to 8.0 g/liter and the fluoride compound is present in an amount of between 0.5 g/liter to 18.0 g/liter, wherein the pH of the solution between 3.5 to 4.0.

11. An acidic aqueous solution according to claim 1 wherein the additive is a chelating agent or multidentate ligand.

12. A process for preparing a corrosion-resistant trivalent chromium conversion coating on metal substrates comprises treating the substrates with an acidic aqueous solution, which is free of hexavalent chromium, comprising a water soluble trivalent chromium compound, a water soluble fluoride compound, and an additive comprising at least one organic amino-phosphonic acid compound for improved corrosion resistance properties, wherein the improved corrosion protection is provided by adsorption of phosphonate groups of the organic amino-phosphonic acid compound on a surface of the metal subtrate to form a Metal-O—P covalent bond and subsequent formation of a network hydrophobic layer over any active corrosion site on the metal subtrate.

13. A process according to claim 12 wherein the additive is a chelating agent or a multidentate ligand.

14. A process according to claim 12 wherein the additive is NTMP.

15. A process according to claim 12 wherein the chelating addictive is present in an amount of between 5 ppm to 100 ppm with respect to the total acidic aqueous solution.

16. A process according to claim 12 wherein the chelating additive is present in an amount of between 5 ppm to 30 ppm with respect to the total acidic aqueous solution.

17. A process according to claim 12 wherein the trivalent chromium compound is present in the solution in an amount of between 0.2 g/liter to 10.0 g/liter and the fluoride compound is present in an amount of between 0.2 g/liter to 20.0 g/liter, wherein the pH of the solution is between pH 2.5 to 4.0.

18. A process according to claim 14 wherein the trivalent chromium compound is present in the solution in an amount of between 0.5 g/liter to 8.0 g/liter and the fluoride compound is present in an amount of between 0.5 g/liter to 18.0 g/liter, wherein the pH of the solution is between 3.5 to 4.0.

19. An article comprising a metal substrate and a trivalent containing conversion coating on the metal substrate, the trivalent containing conversion coating being prepared in accordance with the process of claim 12.

20. An article according to claim 19 wherein the metal is aluminum.

21. An article according to claim 19, wherein the metal substrate is anodized aluminum.

22. An article having improved corrosion protection comprises an aluminum substrate, an anodized coating on the aluminum substrate and a seal-coating on the anodized coating, wherein the seal coating comprises trivalent chromium and phosphorous, wherein the improved corrosion protection is provided by adsorption of phosphonate groups of an organic amino-phosphonic acid compound on a surface of the aluminum substrate to form a Al—O—P covalent bond and subsequent formation of a network hydrophobic layer over any active corrosion site on the aluminum substrate.

* * * * *